United States Patent [19]

Schemel

[11] Patent Number: 4,655,068

[45] Date of Patent: Apr. 7, 1987

[54] FLOATING CYLINDRICAL MANDREL AND METHOD FOR PRODUCING TUBING

[75] Inventor: John H. Schemel, Kennewick, Wash.

[73] Assignee: Sandvik Special Metals Corp., Finley, Wash.

[21] Appl. No.: 714,800

[22] Filed: Mar. 22, 1985

[51] Int. Cl.[4] ..... B21B 21/00

[52] U.S. Cl. ..... 72/208; 72/214; 279/1 SJ; 279/102

[58] Field of Search ..... 72/182, 201, 208, 214; 279/102, 1 SJ, 123

[56] References Cited

U.S. PATENT DOCUMENTS 2,925,282 2/1960 Borsetti ..... 279/123
3,570,294 3/1971 Shibata ..... 72/208
4,184,352 1/1980 Potapov et al. ..... 72/214
4,277,073 7/1981 Ferguson ..... 279/1 SJ

*Primary Examiner*—Francis S. Husar
*Assistant Examiner*—Steve Katz

[57] ABSTRACT

A method and apparatus for producing tubing from hollows or workpieces which are in the form of tubes having greater wall thickness than the finished tubes. The method is carried out upon a mill of the general type known as a McKay rocker. The mandrel is allowed to float in the hollow by being restrained at the rocker crosshead by friction rather than a positive locking device. The rocking is permitted with the mandrel sliding in the crosshead so as to reduce high tensile forces which could otherwise cause mandrel failure.

3 Claims, 5 Drawing Figures

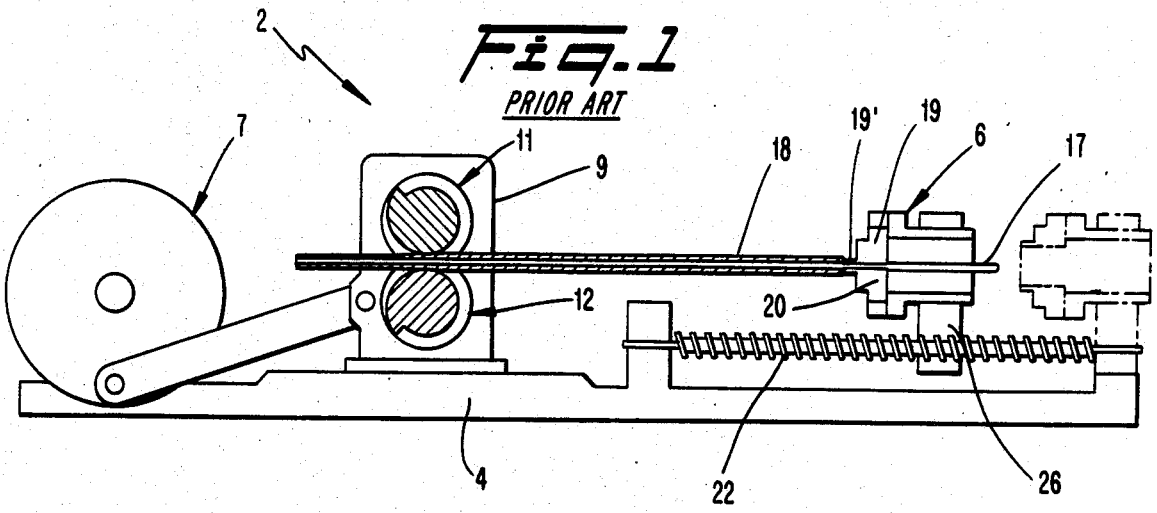
Fig. 1
PRIOR ART
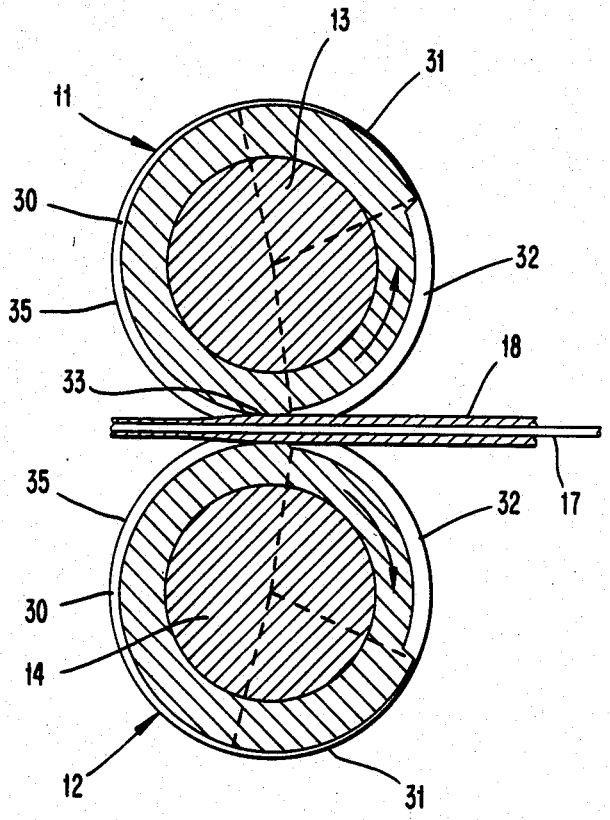
Fig. 2
Fig. 3
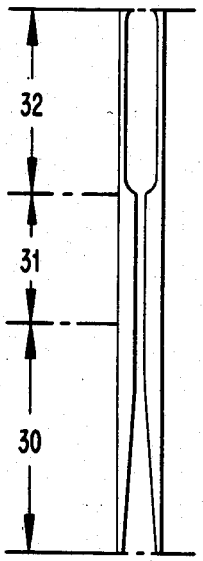

FLOATING CYLINDRICAL MANDREL AND METHOD FOR PRODUCING TUBING

BACKGROUND AND SUMMARY OF THE INVENTION

This invention relates to producing tubes from hollow workpieces, and more in particular to a method and apparatus for producing tubes from mills which have features of prior art mills known as a McKay rocker mill or a FHR reciprocating crosshead type rocker mill. The mill used in practicing the present invention also has features disclosed in U.S. Pat. No. 3,487,675.

Other patents relating to the production of tubular products are disclosed in U.S. Pat. Nos. 4,090,386 and 4,233,834.

U.S. Pat. No. 4,090,386 relates to a method of producing zircaloy tubes of small internal diameter where it is desirable to have high rates of reduction in the wall thickness. The disclosure is directed to zircaloy tubes having close tolerances in inside and outside diameters and from the standpoint of ovality. Further, the rocker mechanism produces tubes with a fine grain structure, improved hydride orientation and higher ratios of strength to ductility. The rocker mechanism permits the workpiece to be turned around its axis a predetermined number of degrees for each time that the workpiece is advanced one step into the forming zone. The mandrel, employed in the production of the tubing, is securely locked within the cross-head of the device.

U.S. Pat. No. 4,233,834 is directed to a method and apparatus for producing zircaloy tubes and the tubing produced by the apparatus in which the spiral formation of the wall-thickness eccentricity is controlled. This is done by controlling the angle at which the metal working forces are exerted so as to minimize the turning moment or torque effect which results in producing the spiral formation of the tubing.

An object of the present invention is to provide improved methods for producing high-quality metal alloy tubes. A further object is to provide for the above in a manner to permit a reduction in the time required to form finished tubes from tubes of greater wall thickness than the finished tubes. A further object is to provide for the above in a manner which overcomes difficulties encountered in the past and which permits high rates of reduction of wall thickness in forming such tubes. This difficulty is encountered when working with metals which do not lubricate well together.

The present invention is particularly directed toward producing metal alloy, most preferably, titanium or zirconium alloy, tubes of small internal diameter from cylindrical workpieces where it is desirable to have high rates of reduction in the wall thickness. It has been found that the invention permits high output rate with increased reduction rates and with less tool cost as represented by avoidance of breakage of mandrels. In the production of metal alloy tubes, such as, for example, titanium or zirconium alloy tubes, cylindrical mandrels may encounter failure by tensile fracture or reduction in diameter during rocking when manufacturing tubes of small O.D., i.e., on the order of 0.250". The problem encountered in the production of tubes of this type is that stress in the mandrel is a combination of compressive stresses in the rolling operation and tensile stresses set up in the mandrel, which is restrained at one end, and held by friction of the reduction cone at the other.

The present invention obviates and/or reduces the problems by utilizing a longer mandrel which is restrained at the rocker crosshead by friction instead of a positive locking force. This arrangement permits the mandrel to slide in the crosshead, upon the application of the proper friction force. Accordingly, the high tensile forces which would otherwise cause mandrel failure are not produced and mandrel life is significantly increased. Other cost savings in equipment downtime, labor time for replacement of mandrels, etc., are also realized.

BRIEF DESCRIPTION OF THE DRAWINGS

FIG. 1 is a schematic side elevation of a prior art traveling cylindrical mandrel;

FIG. 2 is an enlarged vertical sectional view showing the tube forming rolls of FIG. 1;

FIG. 3 is a plan view showing the groove in one of the tube forming rolls in FIGS. 1 and 2;

DETAILED DESCRIPTION OF THE INVENTION

Figure 4:
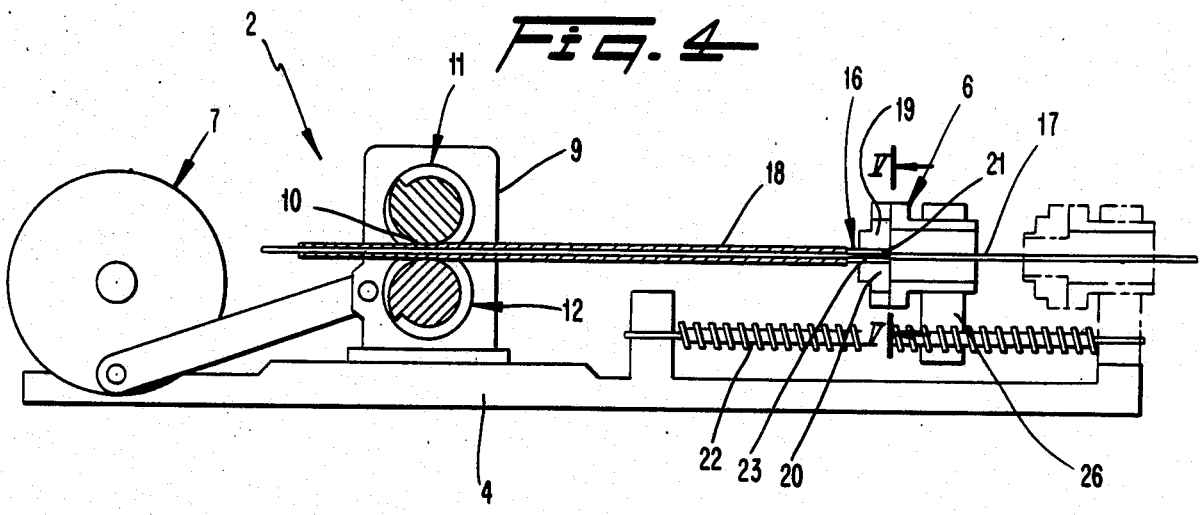
FIG. 4. is a schematic side elevation of a floating cylindrical mandrel of the present invention.

Referring to FIG. 1 of the drawing, a McKay type rocker mill 2 is represented schematically with a stationary base 4, a movable chuck or crosshead 6 in which is securely locked a cylindrical mandrel 17. Of course, it should be understood that an FHR type rocker could also be used. The jaws 19 and 20 lock the mandrel in a fixed position, relative to the jaws, by engagement with cut-out sections, one of which is indicated at 19', provided in the mandrel 17. The mandrel is positioned within the workpiece and has a uniform external diameter which is only slightly less than the internal diameter of the workpiece 18. The left-hand end of the workpiece is shown in a forming zone 10 during the forming operation which is being performed by a pair of forming rolls 11 and 12 rotatably mounted in a movable rollstand 9. Stand 9 is oscillated by a crank arm assembly 7 with the movement being such that the forming zone 10 is moved axially with respect to the workpiece.

During the forming operation, the workpiece is advanced step-by-step into and through the forming zone by a screw thread assembly having a threaded shaft 22 extending through the supporting bracket 26 for the chuck or crosshead 6.

Referring now to FIGS. 2 and 3, rolls 11 and 12 are mounted upon shafts 13 and 14, respectively, and each of them has a groove (see FIG. 3) comprising a primary forming portion 30, a finishing portion 31, and a dwell portion 32. The surfaces of portions 30 and 31 of each of the grooves has a generally semicircular cross-section the axis of which is concentric with the axis of the mandrel and the workpiece when the respective portions of the groove mate at the forming zone as shown in Fig. 4. However, each of the grooves is widened at its edges to provide a relief area 15. The peripheral edges 35 of the rolls mate along a line between the axis of the rolls which intersect the axis of the workpiece. The arc of the dwell portion 32 relative to the roll axis is usually on the order of 60–120°. The primary forming portion 30 is usually longer than the finishing portion 31, and the dwell portion extends the remainder of the circumference of the roll.

During operation, the rollstand oscillates to the right and left from the position shown in FIG. 1, and is, in fact, moving to the left in a primary tube-forming movement of stroke. At that time, portions 30 of the grooves are engaging the workpiece, with roll 11 turning counterclockwise and roll 12 turning clockwise. The movement of the roll stand carrying the rolls relative to the rotation of the rolls is such that the finishing portions 31 of the grooves mate at their ends adjacent the dwell portions 32 when the rollstand and rolls are in the extreme left-hand position. The movements are then reversed simultaneously so that the rolls start to turn in their respective opposite directions at the same time that the rollstand starts to move the rolls to the right. Most of the reduction is normally taken on the forward stroke from the right to the left. Depending on the movement of the workpiece when the rolls roll over the workpiece, a certain amount of the deformation work can be taken during the return stroke from the left to the right.

When the rollstand approaches its extreme right-hand position, the rolls have turned so that the dwell portions 32 of the grooves are mating. At that time, a step-feed movement is produced by turning screw shaft 22 so as to feed the workpiece and the mandrel one step to the left. Simultaneously, chuck 6 rotates the workpiece the predetermined number of degrees as explained above. Each of the movements is then reversed, with the leading ends of the portions 30 of the grooves (shown at the bottom of FIG. 3) moving onto the workpiece and engaging the portion of the workpiece which has been moved into the range of the rolls by the last step advance. That produces the primary tube-forming step with the metal flowing axially along the mandrel. There is a resultant increase in tube length which projects the left-hand end of the workpiece to the left relative to the portion of the workpiece at the right and the left-hand end of the mandrel.

The respective drives to produce the movements of the workpiece and the forming rolls are known in the art. The general construction of the forming rolls is also known in the art, for example, in U.S. Pat. No. 3,487,675 in which forming rolls are supported on a stationary stand and the workpiece and a cylindrical mandrel are oscillated axially within the tube-forming zone. The prior tube-forming mills of the McKay rocker type have stationary mandrels which are tapered. Such mills have certain drawbacks in use for producing tubes of metal alloys such as titanium or zirconium alloys, but they have been used commercially for that purpose. The present invention utilizes certain of the tube-forming principles of the McKay rocker mill and the FHR mill referred to above. In the typical prior McKay rocker mill a tapered mandrel is held stationary with its forward end projecting through the tube-forming zone, and the forming rolls are mounted upon a movable stand and are oscillated, illustratively, by a crank-arm arrangement.

The cylindrical surface of the mandrel against which the inner surface of the workpiece is compressed provides radial forces in opposition to the forces produced by the rolls against the outer surface of the workpiece. For obtaining those advantageous mechanical properties which have been mentioned earlier, a cylindrical mandrel must be used. In a pilger mill of the McKay type, the mandrel is stationary due to the previously discussed locking arrangement. Rocking on a stationary cylindrical mandrel results in high compressive radial stresses and high axial tensile stresses in the mandrel, especially if the reduction is high. If the cylindrical mandrel is fed forward, from the right to the left in FIG. 1, at the same time as the workpiece is being fed, the compressive radial forces in the mandrel will be slightly lower. The axial tensile stresses will be substantially less and the number of loading cycles on any one zone of the mandrel during the rocking of a tube will be less compared with the conditions when using a stationary mandrel. The decrease of the tensile stresses is especially important as the life length of the mandrels is on that part of the S-N fatigue curve where very small changes in stress can lead to a significant change in the mandrel life.

In manufacturing zirconium alloy tubes on the order of 0.250″ OD, as the wall of the tube becomes thicker, i.e., greater than approximately 0.019″, mandrel breakage can occur when producing such tubes. Additionally, it should be observed that the mandrel breakage problem varies with the strength of the material constituting the workpiece. That is, the higher the strength of the workpiece material, the more pronounced the mandrel breakage problem.

With reference to FIG. 4, the mandrel 17 is of a uniform size from end to end. The movable chuck 6 is provided with a friction device indicated generally at 16 for engagement with the mandrel 17. The movable chuck 6 is a multijaw lathe chuck. Two jaws, indicated at 19 and 20, are shown. However, it should be understood that more than two such jaws may be used, if necessary. The jaws, along their radially inwardly directed surfaces, are provided with friction surfaces 21 and 23. The opening and closing of the jaws may be controlled by the use of a torque wrench (not shown) so as to engage the mandrel 17 with a predetermined frictional force as set by the torque wrench. In a preferred embodiment, the material of the friction surfaces 21 and 23 is bronze. The friction surfaces 21 and 23 may be attached to the jaws 19 and 20 by frictional engagement therewith. This may be accomplished by utilizing friction surfaces of greater length than the jaws 21 and 23. The friction surfaces may then be fitted to the jaws with end sections of the friction surfaces extending axially beyond the jaws. The end sections would be bent in a radially outward direction parallel to the radially inwardly directed jaws 19 and 20. A tight friction fitting between the jaws and the end sections would hold the friction surfaces in place with respect to the jaws 19 and 20. Alternatively, the friction surfaces could be fitted to the jaws 19 and 20 by brazing.

The mandrel 17 is gripped by the friction contact surfaces 21 and 23 when the jaws are moved into position, by use of the torque wrench, for engagement with the mandrel. The mandrel 17 is provided as a straight rod with parallel sides. This permits frictional engagement and ensures that no locking engagement of the jaws, with the mandrel, occurs.

Figure 5:
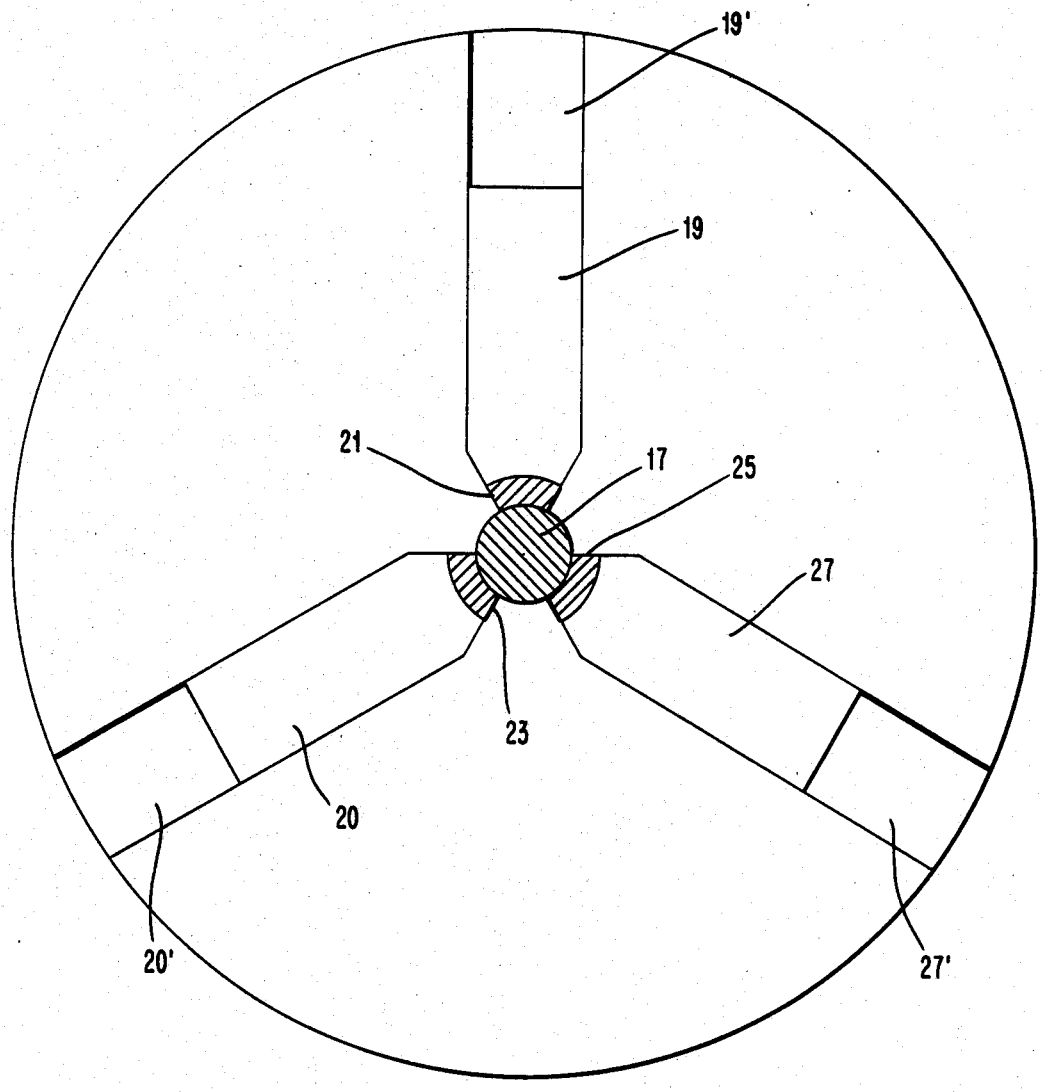
FIG. 5 is a cross-section taken along the lines IV—IV in FIG. 1 and showing a gripping surface in contact with a mandrel.

With reference to FIG. 5, three chuck jaws are shown at 19, 20 and 27. Friction surfaces are indicated at 21, 23 and 25. The friction surfaces are attached to the jaws in the abovedescribed manner. Of course, the chuck jaws 19, 20 and 27 are movable in jaw grooves 19′, 20′ and 27′. The mandrel is indicated at reference numeral 17. As previously discussed, the jaws are brought into contact with the mandrel by a torque wrench actuating a chuck jaw movement mechanism (not shown).

The chuck jaws and their associated friction surfaces grip the mandrel 17 with a predetermined force. The total restraining friction force of the crosshead, on the mandrel, is less than the yield strength of the mandrel. Of course, such a mandrel yield strength can be predetermined. However, the total restraining friction force would be enough to restrain the mandrel from being pulled through the rocker by the movable roll stand 9. Typically, 35 ft.-lbs. of torque may be applied to the chuck jaw movement mechanism so as to securely grip mandrel 17 by friction surfaces 21, 23 and 25. Tightening the jaws of the chuck to 35 ft.-lbs. of torque would be typical for clamping a mandrel of approximately 0.194" diameter. Other amounts of torque which might be applicable to mandrels of different diameter and/or as required by a change in the alloy being worked can be readily determined by one skilled in the art.

As the mandrel is moveable with respect to the crosshead, a range of movement of 9 to 12 inches for a 12 foot tube could be expected. This range of movement would be sufficient to overcome the mandrel breakage problem with respect to the production of tubes of the above-discussed size.

The present invention may be utilized in the production of tubing of the above-described type utilizing refractory (e.g.) tantalium, tungsten and molybdenum or reactive (e.g.) aluminum, magnesium, titanium, zirconium and niobium metals or their alloys. Zirconium and titanium and their alloys are the preferred materials for use in the present invention.

The principles, preferred embodiments and modes of operation of the present invention have been described in the foregoing specification. The invention which is intended to be protected herein should not, however, be construed as limited to the particular forms disclosed, as these are to be regarded as illustrative rather than restrictive. Variations and changes may be made by those skilled in the art without departing from the spirit of the present invention. Accordingly, the foregoing detailed description should be considered exemplary in nature and not limiting to the scope and spirit of the invention as set forth in the appended claims.

What is claimed is:

1. In a method of producing hollow tubes comprising a series of forming steps including:

advancing a cylindrical workpiece of a predetermined external radius and containing a cylindrical mandrel defining the workpiece inner diameter axially into and through a tube-forming zone;

turning a pair of metal forming rolls from a first position with the rolls provided with circumferential tube forming grooves therein, said grooves positioned in mating relationship with said tube forming zone;

turning the rolls in an opposite direction back to said first position;

repeating said advancing step and subsequently repeating said turning steps so as to reciprocate the rolls back and forth from said first position to said second position and advance said cylindrical workpiece;

moving the mandrel with a substantially cylindrical outer surface within the workpiece simultaneously with each of said advancing steps of said workpiece, the moving of the mandrel and the advancing of the workpiece being identical increments of movement from the first position, the diameter of the mandrel being substantially the diameter of said workpiece;

gripping and applying a friction force to the mandrel by a plurality of friction contact surfaces carried by a crosshead so as to restrain the mandrel by said friction force and prevent the mandrel from being pulled through the tube-forming zone, said restraining force being less than the mandrel's yield strength.

2. The method of claim 1, further including:

providing the crosshead with a plurality jaws;

reciprocating said jaws radially within grooves provided in said crosshead to provide for contacting and gripping said mandrel.

3. The method of claim 2, further including:

restraining the mandrel in the crosshead by said friction surfaces thereby preventing said mandrel from being pulled through the tube forming rolls.

* * * * *